US007865122B2

(12) United States Patent
Koyama et al.

(10) Patent No.: US 7,865,122 B2
(45) Date of Patent: Jan. 4, 2011

(54) RECORDING MATERIAL COOLING APPARATUS, AND IMAGE FORMING APPARATUS INCLUDING THE SAME

(75) Inventors: Takaharu Koyama, Ebina (JP); Yoshihiko Ichikawa, Ebina (JP); Shuuichi Yamamura, Ebina (JP); Masayuki Yamamiya, Ebina (JP); Satoru Nishikawa, Ebina (JP); Masayuki Enta, Ebina (JP); Shiro Miyake, Ebina (JP); Naochika Iida, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 218 days.

(21) Appl. No.: 12/137,791

(22) Filed: Jun. 12, 2008

(65) Prior Publication Data

US 2009/0103959 A1 Apr. 23, 2009

(30) Foreign Application Priority Data

Oct. 22, 2007 (JP) ..... 2007-274112

(51) Int. Cl.
*G03G 15/20* (2006.01)
*G03G 21/20* (2006.01)

(52) U.S. Cl. ..... 399/341; 399/92

(58) Field of Classification Search ..... 399/92, 399/320, 341, 407
See application file for complete search history.

(56) References Cited

U.S. PATENT DOCUMENTS 5,032,875 A * 7/1991 Gooray et al. ..... 399/341 X
5,089,857 A * 2/1992 Xydias ..... 399/320 X
5,557,388 A * 9/1996 Creutzmann et al. ..... 399/92
5,805,969 A * 9/1998 Elsermans et al. ..... 399/341
5,970,301 A * 10/1999 De Cock ..... 399/341 X
6,904,260 B2 * 6/2005 Behnke et al. ..... 399/341
7,088,946 B2 * 8/2006 Behnke et al. ..... 399/341
7,558,502 B2 * 7/2009 Kanai ..... 399/92
7,596,349 B2 * 9/2009 Ishiduka ..... 399/341
7,616,921 B2 * 11/2009 Shida et al. ..... 399/341
2007/0071485 A1 3/2007 Yuasa

FOREIGN PATENT DOCUMENTS

JP 4-260065 A 9/1992
JP 2005-62652 A 3/2005
JP 2007-017616 A 1/2007
JP 2007-122044 A 5/2007

OTHER PUBLICATIONS

Chinese Office Action issued in Application No. 2008-10126618.7, dated May 7, 2010.

* cited by examiner

*Primary Examiner*—Sandra L Brase
(74) *Attorney, Agent, or Firm*—Sughrue Mion, PLLC

(57) ABSTRACT

A recording material cooling apparatus includes: a cooling belt that is in contact with a toner-image surface of a recording material on which a toner image is heated by a fixing device to be in a fusing state, to cool the recording material while conveying the recording material; and an air blowing unit that blows air toward the toner-image surface of the recording material which is between the fixing device and the cooling belt, the toner-image surface being in the fusing state, or an air sucking unit that sucks air from the toner-image surface.

17 Claims, 9 Drawing Sheets

RECORDING MATERIAL COOLING APPARATUS, AND IMAGE FORMING APPARATUS INCLUDING THE SAME

CROSS-REFERENCE TO RELATED APPLICATIONS

This application is based on and claims priority under 35 USC 119 from Japanese Patent Application No. 2007-274112 filed on Oct. 22, 2007.

BACKGROUND

Technical Field

The present invention relates to a recording material cooling apparatus, and an image forming apparatus using it.

SUMMARY

According to an aspect of the invention, there is provided a recording material cooling apparatus comprising: a cooling belt that is in contact with a toner-image surface of a recording material on which a toner image is heated by a fixing device to be in a fusing state, thereby cooling the recording material while conveying the recording material; and an air blowing unit that blows air toward the toner-image surface of the recording material which is between the fixing device and the cooling belt, the toner-image surface being in the fusing state, or an air sucking unit which sucks air from the toner-image surface.

BRIEF DESCRIPTION OF THE DRAWINGS

Exemplary embodiments of the present invention will be described in detail based on the following figures, wherein.

DETAILED DESCRIPTION

Hereinafter, embodiments of the invention will be described with reference to the drawings.

Embodiment 1

Figure 2:
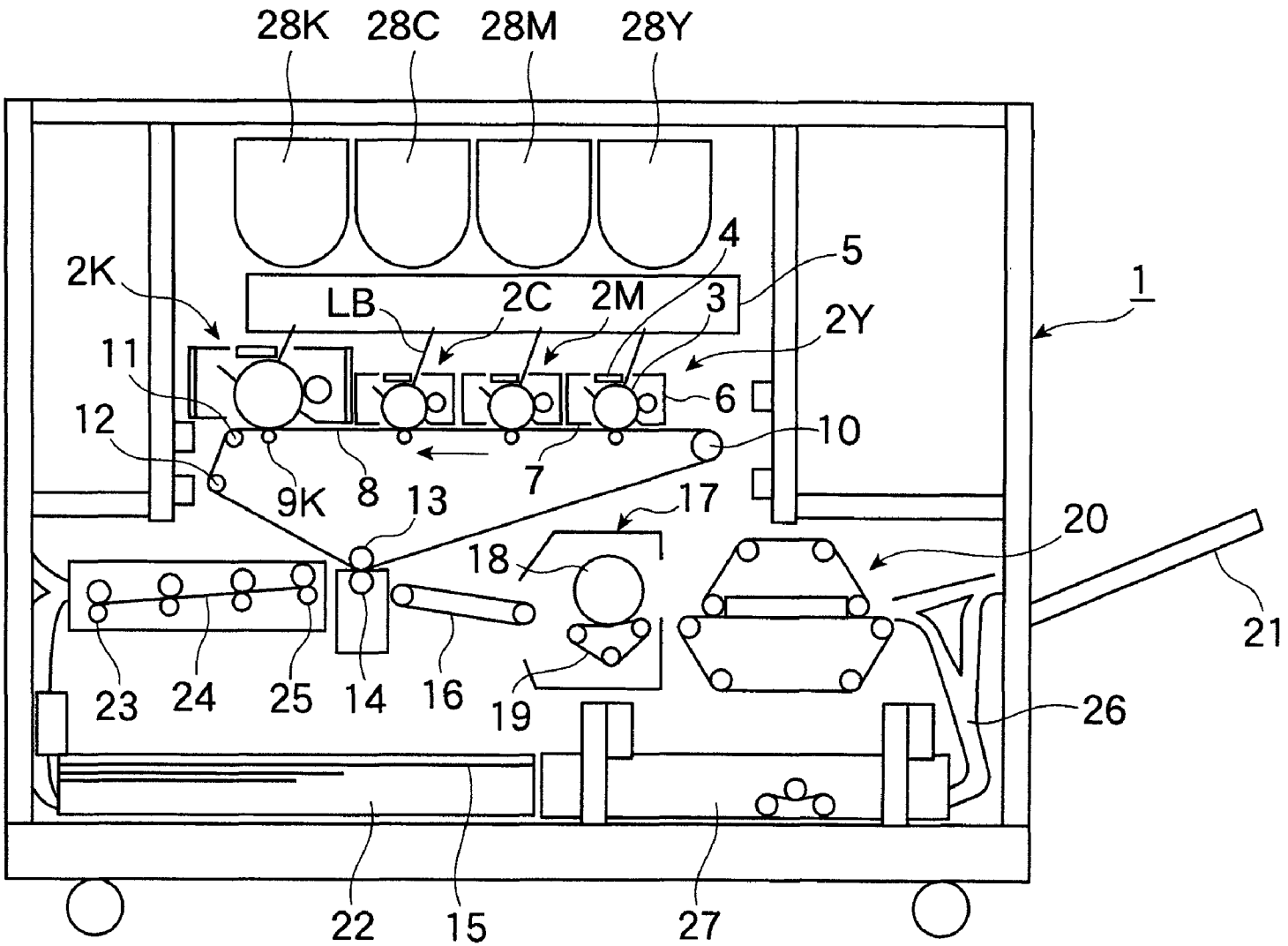
FIG. 2 is a diagram showing a tandem full-color printer that is an image forming apparatus to which the recording material cooling apparatus of Embodiment 1 of the invention is applied.

FIG. 2 shows a tandem full-color printer that is an image forming apparatus to which a recording material cooling apparatus of Embodiment 1 of the invention is applied. The full-color printer is configured as a high-speed apparatus having a productivity in which the number of full-color prints per unit time is as many as about 40 to 50 sheets/min., and outputs an image on the basis of image data sent from a personal computer or the like which is not shown. The tandem full-color printer is not provided with an image reading apparatus. However, it is a matter of course that the apparatus of the invention may be configured as a full-color copier comprising an image reading apparatus, a facsimile apparatus, a multifunction apparatus having the functions of these apparatuses, or the like. The image forming apparatus may employ another type in place of the tandem type.

In FIG. 2, 1 denotes the body of the tandem full-color printer. In the full-color printer body 1, four image forming portions 2Y, 2M, 2C, 2K for yellow (Y), magenta (M), cyan (C), and black (K) are horizontally arranged in parallel at predetermined intervals.

These four image forming portions 2Y, 2M, 2C, 2K are basically configured in the same manner. Each of image forming portions is mainly configured by: a photosensitive drum 3 which is an image carrier rotating in the direction of the arrow at a predetermined rotational speed; a primary charging scorotron 4 which is a charging unit for uniformly charging the surface of the photosensitive drum 3; an image exposing device 5 which exposes the surface of the photosensitive drum 3 by an image based on image data of the corresponding color, to form an electrostatic latent image; a developing device 6 which develops the electrostatic latent image formed on the photosensitive drum 3, with a toner of the corresponding color; and a cleaning device 7 which cleans away a toner and the like residing on the photosensitive drum 3.

The diameter of the photosensitive drum 3K of the image forming portion 2K for black is set to be larger than the diameters of the photosensitive drum 3Y, 3M, 3C for the other colors. The image exposing device 5 is configured in common with the four image forming portions 2Y, 2M, 2C, 2K. It is matter of course that the image exposing device 5 may be disposed for each of the image forming portions 2Y, 2M, 2C, 2K.

In the image forming portions 2Y, 2M, 2C, 2K for the respective colors or yellow (Y), magenta (M), cyan (C), and black (K), image data of the corresponding colors are supplied from an image processing device (not shown) to the image exposing devices 5Y, 5M, 5C, 5K, and the surfaces of the photosensitive drums 3Y, 3M, 3C, 3K are scanned and exposed by laser beams LB which are emitted from the image exposing devices 5Y, 5M, 5C, 5K in accordance with the image data, thereby forming electrostatic latent images. The electrostatic latent images formed on the photosensitive drums 3Y, 3M, 3C, 3K are developed and visualized by the developing devices 6Y, 6M, 6C, 6K as color toner images of yellow (Y), magenta (M), cyan (C), and black (K).

The color toner images of yellow (Y), magenta (M), cyan (C), and black (K) which are formed on the photosensitive drums 3Y, 3M, 3C, 3K of the image forming portions 2Y, 2M, 2C, 2K are multiply transferred by primary transfer rolls 9Y, 9M, 9C, 9K onto an intermediate transfer belt 8 which is an endless intermediate transfer member placed below the image forming portions 2Y, 2M, 2C, 2K. The intermediate transfer belt 8 is wound by a predetermined tension around plural rolls such as a driving roll 10, a tension roll 11, a steering roll 12, and a backup roll 13, and driven to cyclically move along the direction of the arrow at a predetermined speed, by the driving roll 10 which is rotated by a dedicated driving motor (not shown) having an excellent constant speed property. As the intermediate transfer belt 8, for example, an endless belt-like product may be employed which is formed by forming a flexible film of a synthetic resin such as PET or polyimide into a belt like shape, and connecting the both ends of the belt-shaped synthetic resin film to each other by welding or the like. The endless belt may be either seamed or seamless.

The color toner images of yellow (Y), magenta (M), cyan (C), and black (K) which are multiply transferred onto the intermediate transfer belt 8 are secondary-transferred onto a recording sheet 15 which is a recording material, by a pressure and electrostatic force exerted by a secondary transfer roll 14 which is pressure contacted with the backup roll 13. The recording sheet 15 onto which the color toner images are transferred is conveyed to a fixing device 17 by a conveyor belt 16. The recording sheet 15 onto which the color toner images are transferred is caused to undergo a fixing process by a heating roll 18 and a fixing belt 19 of the fixing device 17. Thereafter, the recording sheet is cooled by a recording material cooling apparatus 20, and discharged onto a discharge tray 21 which is disposed outside the printer body 1. The toner image which has been passed through the fixing device 17 to be fixed onto the recording material 15 is introduced into the recording material cooling apparatus 20 while remaining in a fusing or near-fusing state.

As shown in FIG. 2, the recording sheet 15 having a predetermined size and quality is fed by a sheet feed roll (not shown) from a sheet feed tray 22 which is disposed in a bottom portion of the printer body 1 to be conveyed to a registration roll 25 through a sheet conveying path 24 comprising plural conveying rolls 23, and once stopped there. The recording sheet 15 supplied from the sheet feed tray 22 is sent to a secondary transfer station of the intermediate transfer belt 8 by the registration roll 25 which is rotated at a predetermined timing. The recording material 15 is not restricted to a recording sheet which is plain paper, and may be selected from a wide variety of recording materials including cardboards such as coated paper, and an OHP sheet.

In the case where images are to be formed on the both surfaces of the recording sheet 15, the recording sheet 15 in which an image is formed on one surface is not discharged onto the discharge tray 21, and, after the sheet is cooled by the recording material cooling apparatus 20, the conveying path for the recording sheet 15 is switched to a both-side conveying path 26 in the lower side, and the recording sheet is once housed in a sheet inverting tray 27. The recording sheet 15 which is housed in the sheet inverting tray 27 is conveyed to the registration roll 25 in a state where the surfaces are inverted by the sheet inverting tray 27, through a sheet conveying path (not shown) disposed above the sheet feed tray 22, and the usual sheet conveying path 24. An image is formed on the rear surface of the recording sheet 15, and the recording sheet is then discharged to the discharge tray 21 through the fixing device 17 and the recording material cooling apparatus 20.

In FIG. 2, the reference numerals 28Y, 28M, 28C, 28K denote toner cartridges which are disposed in an upper portion of the printer body 1, and which house color toners of yellow (Y), magenta (M), cyan (C), and black (K), respectively.

The recording material of the embodiment comprises: the fixing device which heats the recording material to fix a toner image onto the recording material; a cooling belt that is in contact with a toner-image surface of the recording material on which the toner image is heated by the fixing device to be in a fusing state, thereby cooling the recording material while conveying the recording material; and an air blowing unit that blows air toward the toner-image surface of the recording material which is between the fixing device and the cooling belt, the toner-image surface being in the fusing state, or an air sucking unit which sucks air from the toner-image surface.

Figure 3:
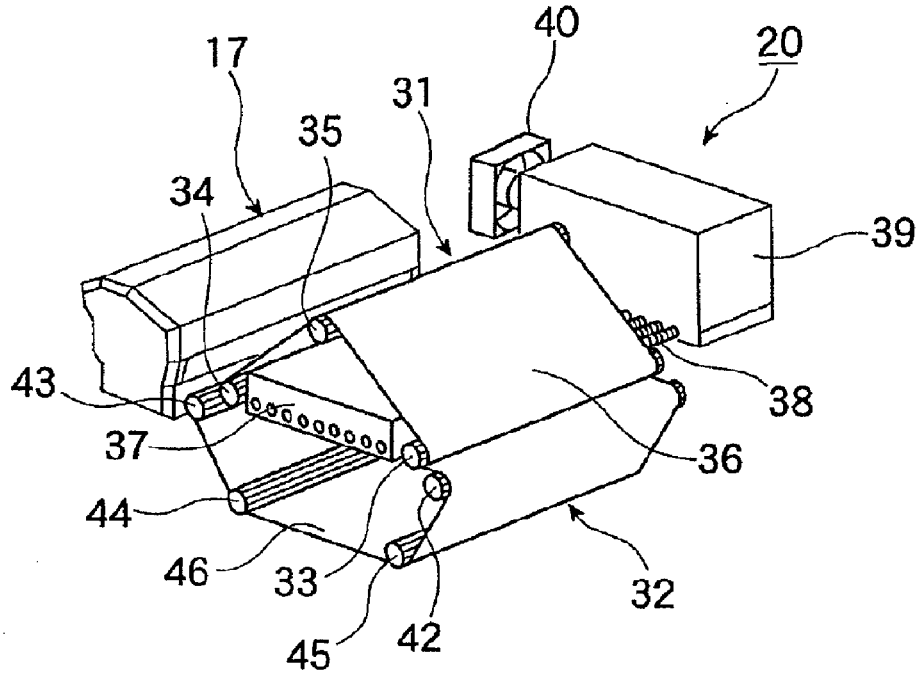
FIG. 3 is a perspective diagram showing main portions of the recording material cooling apparatus of Embodiment 1 of the invention.

FIG. 3 is a diagram showing the configuration of the recording material cooling apparatus of Embodiment 1 of the invention.

As shown in FIG. 3, the recording material cooling apparatus 20 is disposed in the vicinity of the fixing device 17 and on the downstream side of the conveying direction of the recording material, and mainly configured by an upper belt unit 31 and a lower belt unit 32. The upper belt unit 31 comprises: plural stretch rolls 33 to 35 including a driving roll; a cooling belt 36 which is an endless belt wound by a predetermined tension around the plural stretch rolls 33 to 35; and a cooling block 37 which is disposed inside the cooling belt 36, and which is a part of a cooling unit for cooling the cooling belt 36. Plural heat pipes 38 are inserted into the cooling block 37 in a state where one end portions of the pipes are projected. A heat sink 39 is disposed in tip end portions of the heat pipes 38 so as to be cooled by an air blowing fan 40. The heat pipes 38 are used for transferring heat between the cooling block 37 and the heat sink 39, and configured so that heat is transferred from the cooling block 37 which is thermally hot to the heat sink 39 which is cooled by the air blowing fan 40.

The plural stretch rolls 33 to 35 are basically configured in the same manner, and, for example, formed into a columnar or cylindrical shape having an outer diameter of about 28 to 30 mm by a metal such as aluminum or stainless steel, or a hard synthetic resin. The driving roll 33 is placed adjacent to and downstream from the cooling block 37 in the moving direction of the cooling belt 36, so as to directly give a driving force to the cooling belt 36 which passes over the cooling block 37. The driving roll 33 is rotated at a predetermined speed (for example, a peripheral speed of 150 to 200 mm/sec.) by a driving source which is not shown.

Figure 1:
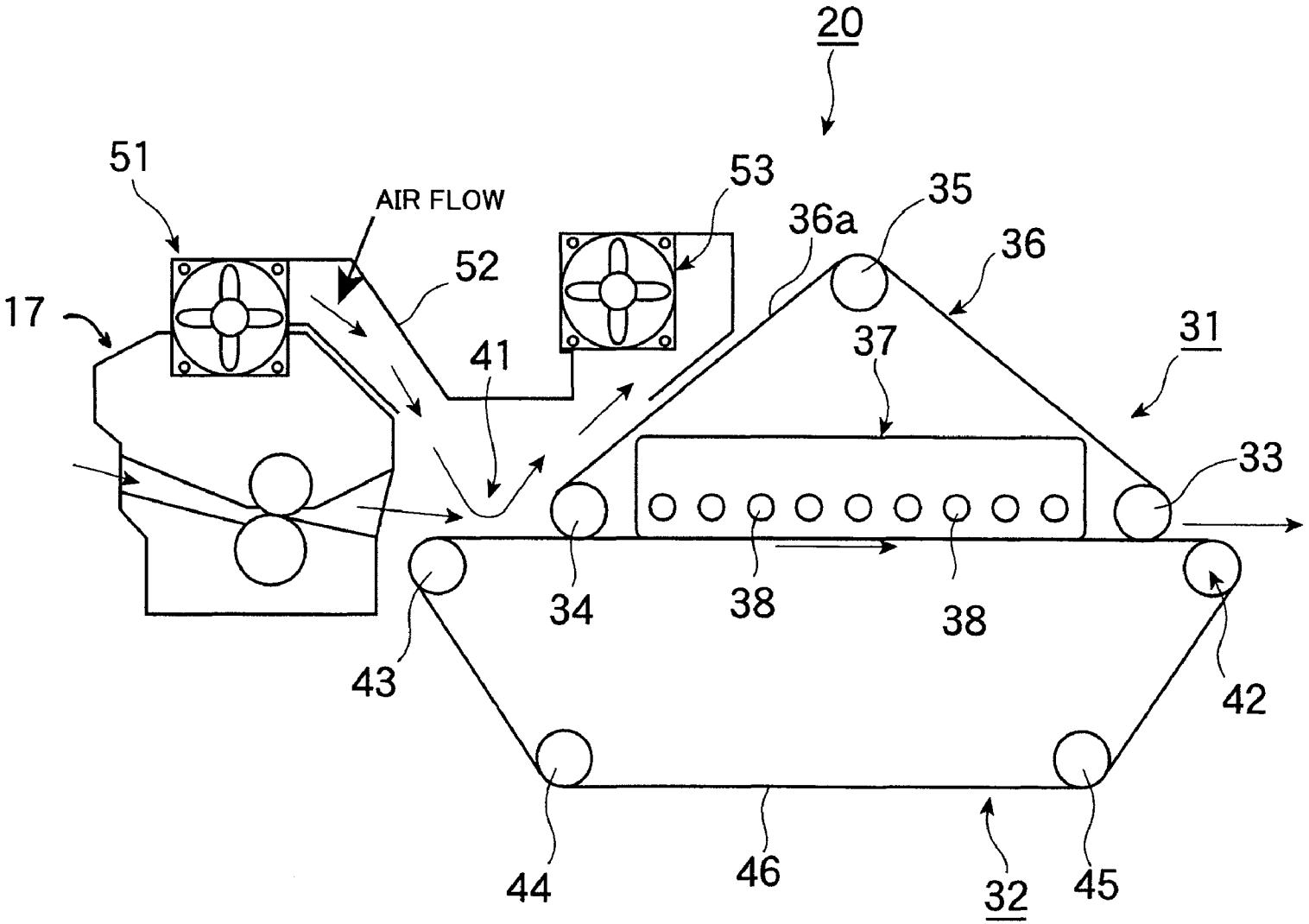
FIG. 1 is a diagram showing a recording material cooling apparatus and a fixing device of Embodiment 1 of the invention.

Between the driving roll 33 and the first stretch roll 34 which is placed adjacent to and upstream from the driving roll 33 via the cooling block 37 in the moving direction of the cooling belt, the cooling belt 36 is stretched in a substantially planar manner. Between the driving roll 33 and the first stretch roll 34, as shown in FIG. 1, the cooling belt 36 is pressingly in planar contact with a conveyor belt 46 which will be described later. A predetermined tension (for example, about 19 to 39 N (about 2 to 4 kgf)) is applied to the cooling belt 36 by, for example, the second stretch roll 35.

The cooling belt 36 is stretched so that its side view shape is approximately triangular, by the first stretch roll 34 and the second stretch roll 35. In the cooling belt 36, a stretched slope 36*a* is formed on the side of the fixing device 17 by the first stretch roll 34 and the second stretch roll 35.

For example, an endless belt configured by a polyimide film having a thickness of 120 μm, a width of 360 mm, and a predetermined circumference length is used as the cooling belt 36. Of course, an endless belt of another material and size may be used.

As shown in FIG. 3, the cooling block 37 is formed into a rectangular parallelpiped shape having a predetermined height, by a metal having a high thermal conductivity, such as aluminum. Into the cooling block 37, the plural heat pipes 38 are inserted at positions close to the cooling belt 36 in a direction perpendicular to the moving direction of the cooling belt 36. One end portions of the plural heat pipes 38 are projected so as be projected from the cooling block 37. The heat sink 39 is connected to the tip end portions of the heat pipes 38. The heat sink 39 is formed into a rectangular parallelpiped shape by placing many thin plates of a metal such as aluminum in parallel with forming small gaps therebetween. The air blowing fan 40 directed in the direction parallel to the metal thin plates is disposed on the side face of the heat sink 39. The air blowing fan 40 blows air to the gaps between the metal thin plates, thereby cooling the heat sink 39.

By contrast, as shown in FIGS. 1 and 3, the lower belt unit 32 comprises: plural (four, in the illustrated example) stretch rolls 42 to 45 including a driving roll; and a conveyor belt 46 which is an endless belt member wound by a predetermined tension around the plural stretch rolls 42 to 45. Plural backup rolls which function as a pressing member for causing the conveyor belt 46 to be in press contact with the cooling block 37 may be disposed inside the conveyor belt 46.

The plural stretch rolls 42 to 45 are basically configured in the same manner, and, for example, formed into a columnar or cylindrical shape having an outer diameter of about 28 to 30 mm by a metal such as aluminum or stainless steel, or a hard synthetic resin. The driving roll 42 is placed adjacent to and downstream from a region 47 which is in press contact with the cooling block 37 along the moving direction of the conveyor belt 46, so as to directly give a driving force to the conveyor belt 46 which passes over the cooling block 37. The driving roll 42 is rotated at the same speed as the driving roll 33 (for example, a peripheral speed of 150 to 200 mm/sec.) by the driving source which is not shown.

Figure 4:
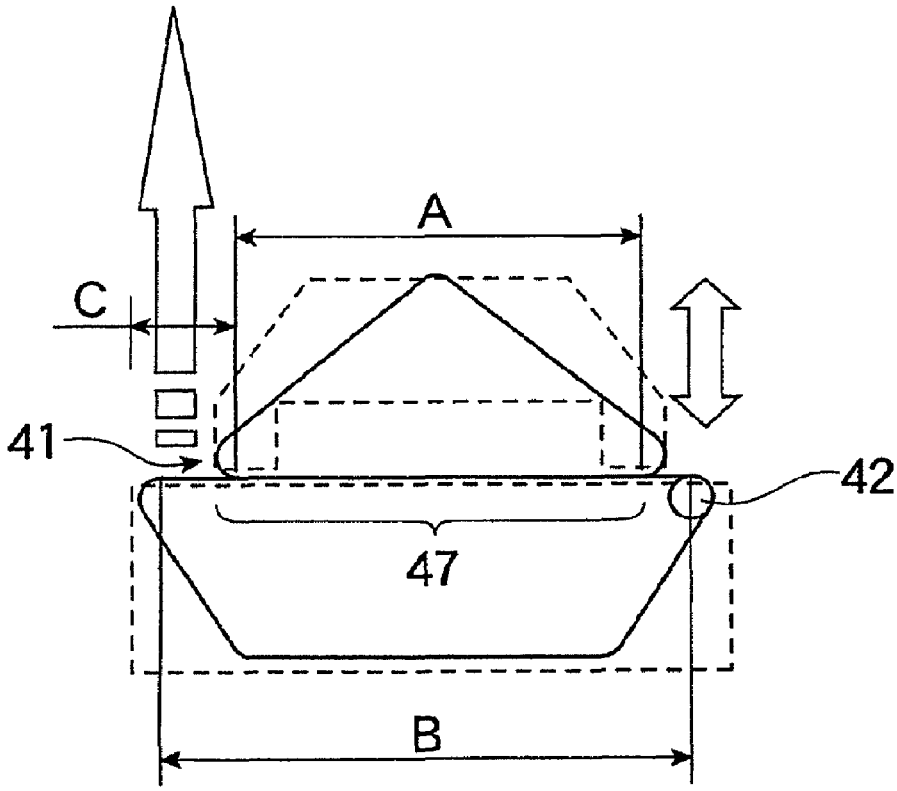
FIG. 4 is a diagram showing the function of the recording material cooling apparatus of Embodiment 1 of the invention.

Between the driving roll 42 and the first stretch roll 43 which is placed closest to and upstream from the driving roll via the cooling block 37 in the moving direction of the conveyor belt 46, the conveyor belt 46 is stretched in a substantially planar manner. As shown in FIG. 4, the axis-to-axis distance B between the driving roll 42 and the first stretch roll 43 is set to be longer than the axis-to-axis distance A between the driving roll 33 and the first stretch roll 34, so that there is a zone for conveying the recording material which has been discharged from the fixing device 17, and which has not yet entered the cooling belt 36, above the conveyor belt 46 which is stretched by the driving roll 42 and the first stretch roll 43. In the embodiment, the zone is referred to as the non-nipping portion 41. A predetermined tension (for example, about 19 to 39 N (about 2 to 4 kgf)) is applied to the conveyor belt 46.

The conveyor belt 46 is stretched so that its side view shape is approximately trapezoidal, by the first stretch roll 43, the second stretch roll 44, and the third stretch roll 45.

For example, an endless belt configured by a polyimide film having a thickness of 120 μm, a width of 360 mm, and a predetermined circumference length is used as the conveyor belt 46. The conveyor belt 46 is configured so as to have a circumference length different from that of the cooling belt 36. Of course, the conveyor belt may be configured in the same manner as the cooling belt 36. In this case, the number of stretch rolls for stretching the conveyor belt 46 and the cooling belt 36 is adequately determined.

As shown in FIG. 3, the recording material 15 in which a full-color toner image is fixed by the fixing device 17 to the front surface or the front and rear surfaces is introduced into the thus configured recording material cooling apparatus 20. In the nipping region 47 where the cooling belt 36 and the conveyor belt 46 are press contacted with each other, while the recording material 15 onto which the image is fixed is conveyed in a nipped state, the heat of the recording material 15 is absorbed by the cooling belt 36 and the cooling block 37, thereby cooling the recording material. The recording material 15 is introduced into the recording material cooling apparatus 20 immediately after the recording material is passed through the fixing device 17. Therefore, the toner image which is fixed to the image surface (the upper surface) of the recording material 15 is in a fusing or near-fusing state. In the case where an image is formed on both the surfaces of the recording material 15, an image which is previously formed on one surface of the recording material 15 is once passed through the recording material cooling apparatus 20, and hence the temperature of the image is lower than that of an image which is lately formed. In another case, even when an image which is previously formed is not passed through the recording material cooling apparatus 20, the image is gradually cooled during conveyance, and hence the temperature of the image is lower than that of an image which is lately formed.

Figure 5:
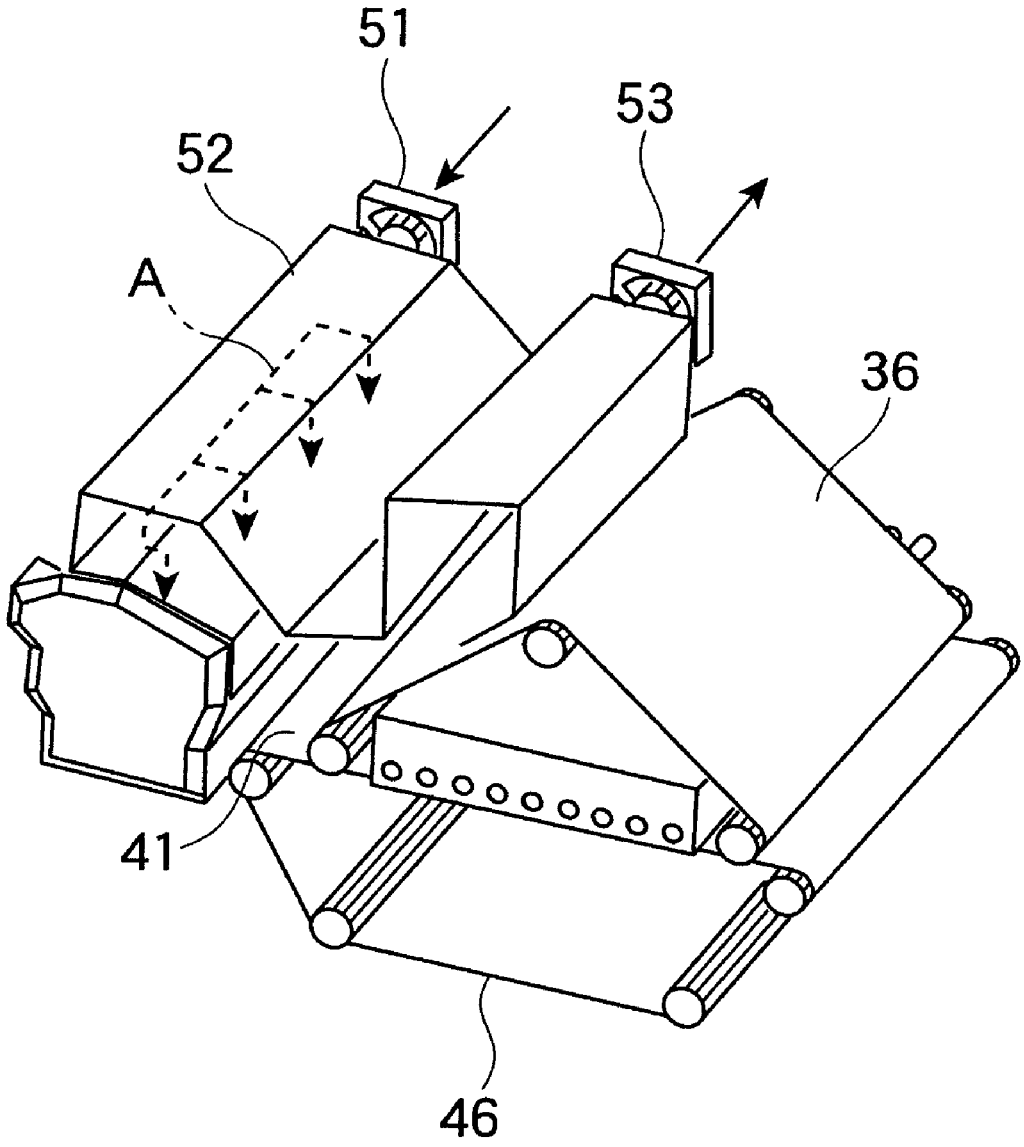
FIG. 5 is a perspective diagram showing the recording material cooling apparatus of Embodiment 1 of the invention.

As shown in FIG. 1, the recording material cooling apparatus 20 of the embodiment is configured so that air is blown to the recording material 15 which is passed over the conveyor belt 46 from the side of the fixing device 17. The air blowing is performed by an exhaust fan 51 which is disposed above the fixing device 17 and in the front or rear side in the depth direction of the fixing device 17 as shown in FIG. 5. The air of the image forming portions in the vicinity of the fixing device 17 is sucked by the exhaust fan 51, and blown toward the non-nipping portion 41 of the conveyor belt 46 through a duct 52. Above the slope of the cooling belt 36, a suction fan 53 is disposed in one end portion in a direction perpendicular to the moving direction of the cooling belt 36, so that air containing vapor generated in the non-nipping portion 41 is upward sucked along the slope of the cooling belt 36 which is placed above the conveyor belt 46, and the sucked air in the duct 52 is discharged to the outside of the apparatus body 1. Alternatively, the suction fan may not be disposed, and the air flow containing vapor is caused to upward flow, only by the exhaust fan 51. In FIG. 5, the duct 52 is opened only in portions corresponding to the exhaust fan 51 and the suction fan 53.

The duct 52 is disposed over the range from the portion above the fixing device 17 to a middle of the slope of the cooling belt 36 through the non-nipping portion 41 of the conveyor belt 46, so as to airtightly cover these members. The exhaust fan 51 is disposed in an end portion of the duct 52 on the side of the fixing device 17, and the suction fan 53 is disposed in an end portion of the duct on the side of the slope of the cooling belt 36, so that air is blown from the side of the fixing device 17 to the cooling belt 36 along the conveying direction of the recording material 15.

In the full-color printer to which the recording material cooling apparatus of Embodiment 1 is applied, as shown in FIG. 2, the image forming portions 2Y, 2M, 2C, 2K for yellow (Y), magenta (M), cyan (C), and black (K) form color toner images of yellow (Y), magenta (M), cyan (C), and black (K) on the photosensitive drums, and the color toner images are multiply transferred onto the intermediate transfer belt 8, and then collectively secondary-transferred from the intermediate transfer belt 8 onto the recording sheet 15.

The unfixed toner image is fixed by means of heat and pressure exerted by the fixing device 17 onto the recording sheet 15. During when the recording sheet is then conveyed by the recording material cooling apparatus 20, heat is lost, and the recording material is cooled. Then, the recording sheet is discharged onto the discharge tray 21, thereby ending the print process.

During the process, in the recording material cooling apparatus 20, as shown in FIG. 3, the first conveyor belt 36 and the second conveyor belt 46 are driven so as to cyclically move at the predetermined speed by the first and second driving rolls 33, 42 in the state where the belts are in press contact with each other, and, as shown in FIG. 1, the recording sheet 15 which has undergone the fixing process by means of heat and pressure exerted by the fixing device 17 is introduced into the nipping region 47 between the cooling belt 36 and the conveyor belt 46.

During when the recording sheet 15 is conveyed in the state where it is nipped by the cooling belt 36 and the conveyor belt 46, heat is lost by the cooling belt 36, and the heat transmitted to the cooling belt 36 is absorbed by the cooling block 37.

When an unfixed toner image is fixed to the recording sheet 15 by the fixing device 17, the recording sheet is heated to a high temperature. Therefore, also the recording sheet 15 which has been passed through the fixing device 17 remains at a high temperature. In the case where the recording sheet 15 is in a moisture absorbed state, therefore, the water content is evaporated from the recording sheet 15 heated by the fixing device 17 to generate water vapor, or the generated water vapor is cooled to condense out water. When the recording sheet 15 which has been passed through the fixing device 17 is immediately conveyed in the recording material cooling apparatus 20 in the state where it is nipped by the cooling belt 36 and the conveyor belt 46, there is a possibility that the toner image is disturbed by vapor, dew condensation, or the like which is generated from the recording material 15.

In the embodiment, therefore, air sucked from the image forming portions by the exhaust fan 51 is blown from the obliquely upward side to the recording sheet 15 which has been passed through the fixing device 17, as shown in FIG. 1, whereby a wind force is caused to act in the direction in which the recording material is pressed against the conveyor belt. Even in the case where the recording sheet 15 is conveyed at a high speed by the air blowing while vapor and the like generated from the recording sheet 15 are surely eliminated, consequently, the recording sheet is suppressed from rising from the conveyor belt 46.

In the embodiment, a pressure channel is formed, so that air in the vicinity of the non-nipping portion 41 does not move to the fixing device 17, particularly to a fixing portion. Furthermore, a fan (not shown) for exhausting heat from the fixing device 17 is disposed above the fixing device 17. The fan adjusts the air pressures in the vicinities of the non-nipping portion 41 and the fixing device by means of the air flow amount of the fan so that the air pressure in the vicinity of the fixing device 17 is reduced but air movement from the non-nipping portion 41 to the fixing portion of the fixing device 17 is not caused by the difference between the air pressures.

Vapor generated from the recording material 15 is caused by air exhaustion from the exhaust fan 51 to pass through the recording sheet 15 conveyed by the conveyor belt 46, and then discharged to the outside of the apparatus by the suction fan 53 disposed above the slope of the cooling belt 36.

In the recording material cooling apparatus 20, as shown in FIG. 3, the cooling belt 36 and the conveyor belt 46 are driven so as to cyclically move at the predetermined speed by the driving rolls 33, 42 in the state where the belts are in press contact with each other, and, as shown in FIG. 1, the recording sheet 15 which has undergone the fixing process by means of heat and pressure exerted by the fixing device 17 is cooled by the cooling block 37 through the cooling belt 36 during when the sheet is conveyed by the cooling belt 36 and the conveyor belt 46.

Embodiment 2

Figure 6:
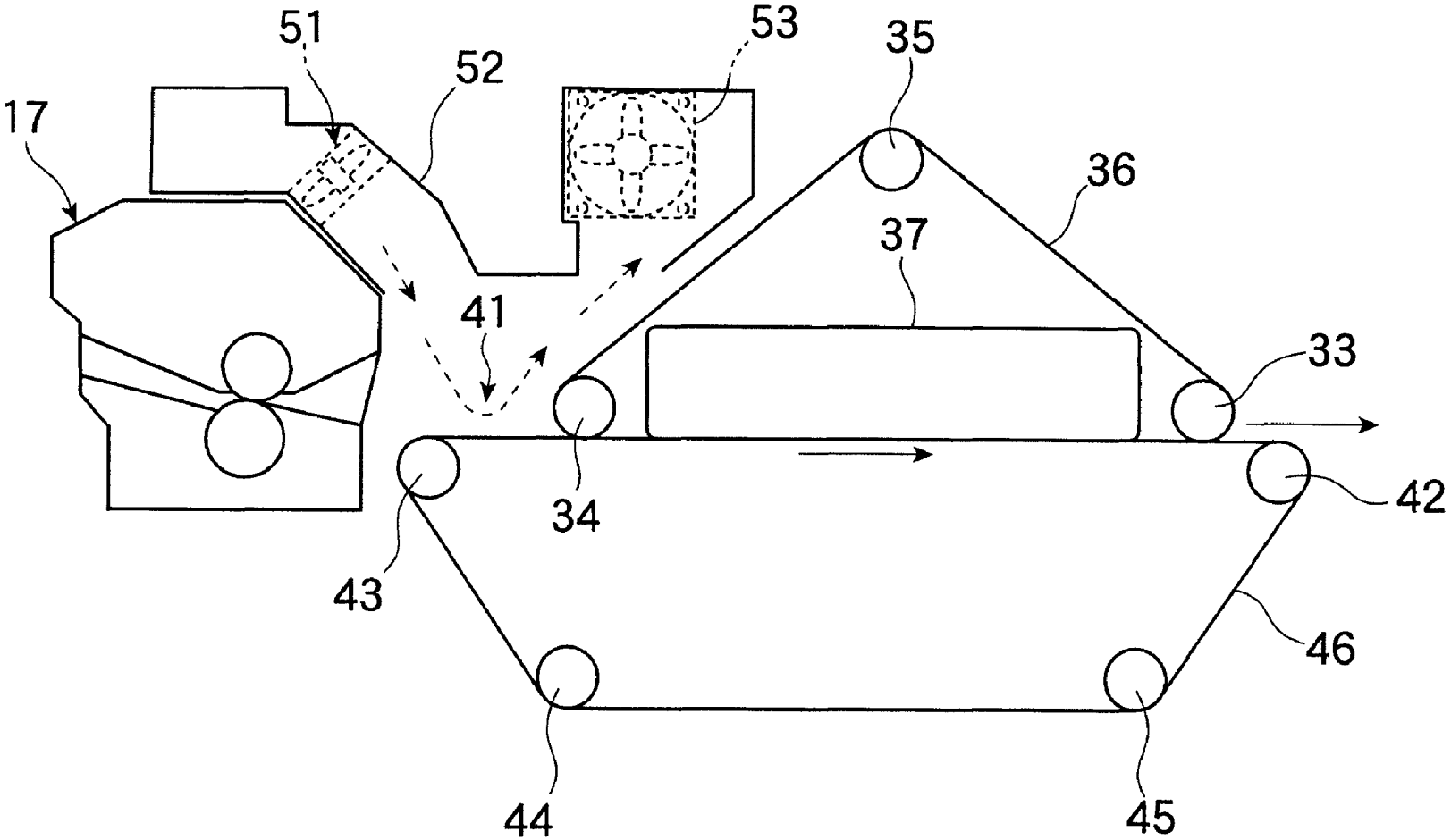
FIG. 6 is a diagram showing a recording material cooling apparatus and a fixing device of Embodiment 2 of the invention.

FIG. 6 shows Embodiment 2 of the invention. The following description will be made while the portions which are identical with those of Embodiment 1 are denoted by the same reference numerals. Embodiment 2 is configured so that the exhaust fan disposed on the side of the image forming portions is not placed in the end portion of the fixing device in the depth direction, but disposed in a plural number in a middle of a duct through which air on the side of the fixing device is exhausted.

Specifically, in Embodiment 2, as shown in FIG. 6, the exhaust fan 51 disposed on the side of the image forming portions is not placed in the end portion of the fixing device in the depth direction, but disposed in a plural number in a middle of the duct 52, and air is directly blown from the plural exhaust fans 51 toward the recording material 15 positioned in the non-nipping portion 41 on the conveyor belt 46.

As a result, the air flow which is blown from the plural exhaust fans 51 toward the recording material 15 on the conveyor belt 46 is intensified, and the force which presses the recording sheet 15 onto the conveyor belt 46 is enhanced. When the pressing force is enhanced, the rising of the recording sheet 15 is reduced. When the rising of the recording sheet is increased, jamming or the like may occur due to the rising. This function is applied also to the case where the discharge speed of the recording sheet 15 discharged from the fixing device 17 is increased by increasing the fixing speed of the fixing device 17.

The other configuration and function are identical with those of Embodiment 1, and hence their description is omitted.

Embodiment 3

Figure 7:
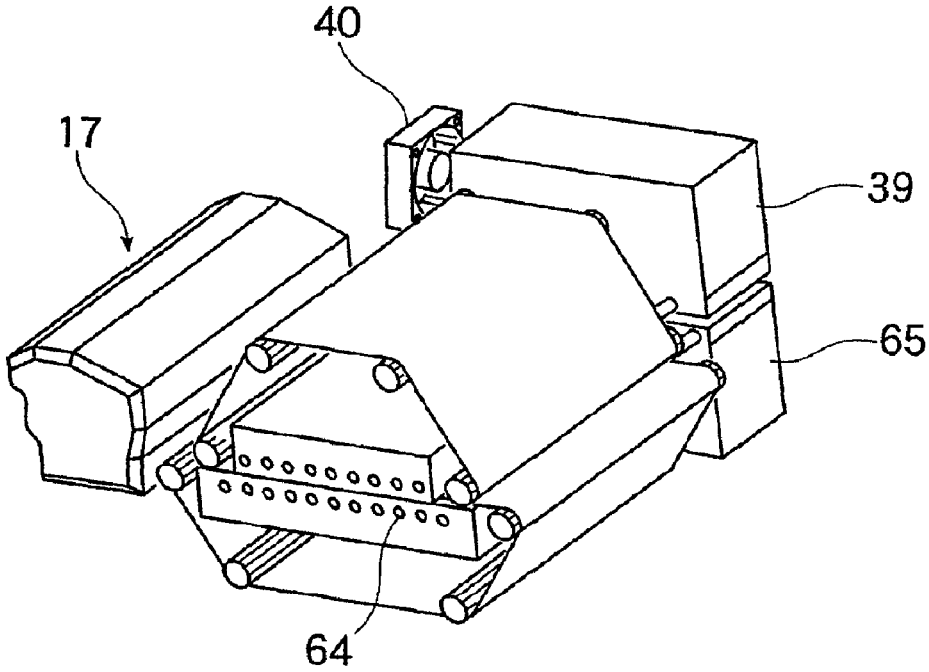
FIG. 7 is a perspective diagram showing a recording material cooling apparatus and a fixing device of Embodiment 3 of the invention.

FIG. 7 shows Embodiment 3 of the invention. The following description will be made while the portions which are identical with those of Embodiment 1 are denoted by the same reference numerals. Embodiment 3 is configured so that the cooling efficiency of the recording material is improved by increasing the force of nipping the recording material.

Figure 8:
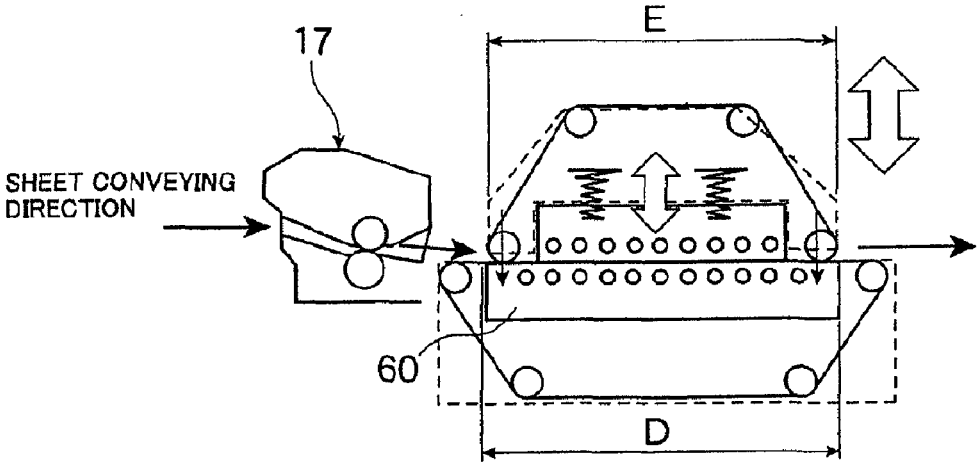
FIG. 8 is a diagram showing the function of the recording material cooling apparatus of Embodiment 3 of the invention.

Specifically, in Embodiment 3, as shown in FIG. 8, a cooling block 60 which is configured in a similar manner as the cooling block 37 disposed inside the cooling belt 36 is disposed inside the conveyor belt 46. In the cooling block 60, the length D along the moving direction of the conveyor belt 46 is set to be larger than the length E of the cooling block 37 disposed inside the cooling belt 36, so that the conveyor belt 46 is in press contact with the cooling belt 36 over the whole region of the cooling belt 36.

The cooling block 60 is configured similarly to the cooling block 37 in the upper side. Plural heat pipes 64 are inserted into the cooling block 60, and a heat sink 65 is attached to end portions of the heat pipes 64 projecting from the cooling block 60. Moreover, the heat sink 65 is air-cooled by an air blowing fan which is not shown.

In the configuration where the cooling block 60 is disposed inside the conveyor belt 46 and press contacted with the cooling block 37 inside the cooling belt 36 as described above, the cooling efficiency of the recording material 15 is further improved.

The other configuration and function are identical with those of Embodiment 1, and hence their description is omitted.

Embodiment 4

Figure 9:
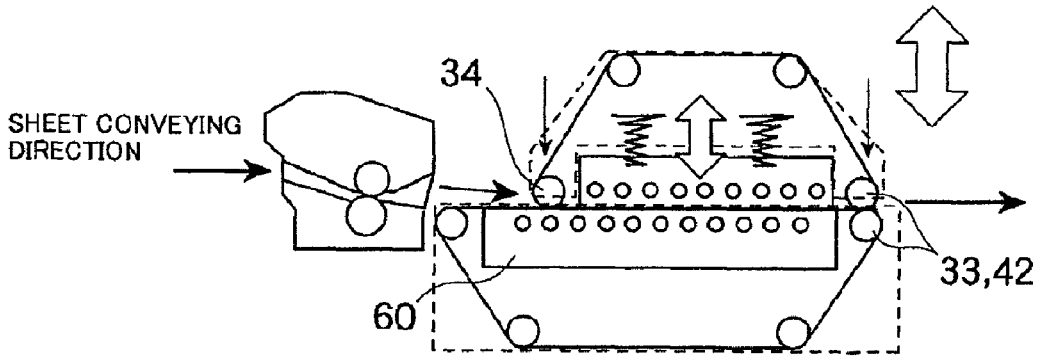
FIG. 9 is a diagram showing a recording material cooling apparatus of Embodiment 4 of the invention.
Figure 10:
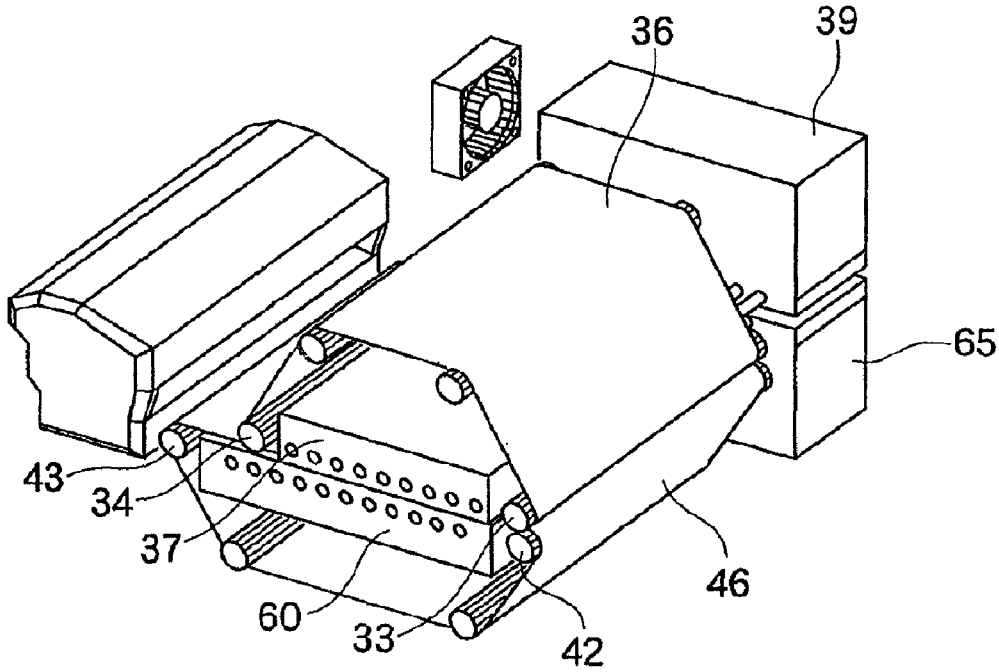
FIG. 10 is a perspective diagram showing the recording material cooling apparatus of Embodiment 4 of the invention.

FIGS. 9 and 10 show Embodiment 4 of the invention. The following description will be made while the portions which are identical with those of Embodiment 1 are denoted by the same reference numerals. Embodiment 4 is configured by the driving roll on the side of the cooling belt, and the driving roll which is the stretch roll opposed to the driving roll of the cooling belt, and which drives the conveyor belt, whereby the cooling belt and the conveyor belt can be surely driven.

Specifically, in Embodiment 4, as shown in FIGS. 9 and 10, the driving roll 33 which drives the cooling belt 36, and the driving roll 42 which drives the conveyor belt 46 are placed so as to be press contacted with each other, and the stretch roll 34 for the cooling belt 36 is press contacted with the cooling block 60 on the side of the conveyor belt 46.

According to the configuration, the force by which the cooling belt 36 and the conveyor belt 46 are press contacted with each other is increased, the close contact between the recording material 15 and the cooling belt 36 is enhanced, and the cooling efficiency of the recording material 15 is improved. Since the driving rolls 33, 42 are driven in a state where they are press contacted with each other, the cooling belt 36 and the conveyor belt 46 can be surely driven.

The other configuration and function are identical with those of Embodiment 1, and hence their description is omitted.

Embodiment 5

Figure 11:
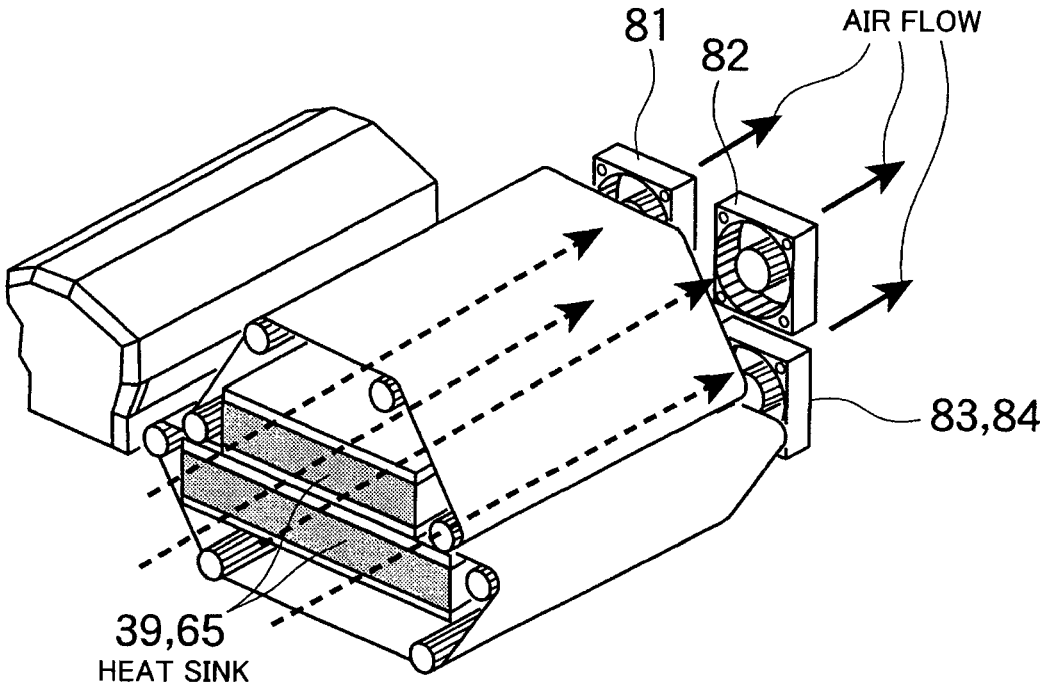
FIG. 11 is a perspective diagram showing a recording material cooling apparatus of Embodiment 5 of the invention.

FIG. 11 shows Embodiment 5 of the invention. The following description will be made while the portions which are identical with those of Embodiment 1 are denoted by the same reference numerals. Embodiment 5 is configured so that, in place of the configuration where the cooling blocks are disposed inside the cooling belt and the conveyor belt, and the cooling blocks are coupled to a heat sink by heat pipes, heat sinks are disposed directly inside the cooling belt and the conveyor belt.

Specifically, in Embodiment 5, as shown in FIG. 11, heat sinks 39, 65 are disposed directly inside the cooling belt 36 and the conveyor belt 46, and air from the heat sinks 39, 65 is sucked by suction fans 81 to 84.

Figure 12:
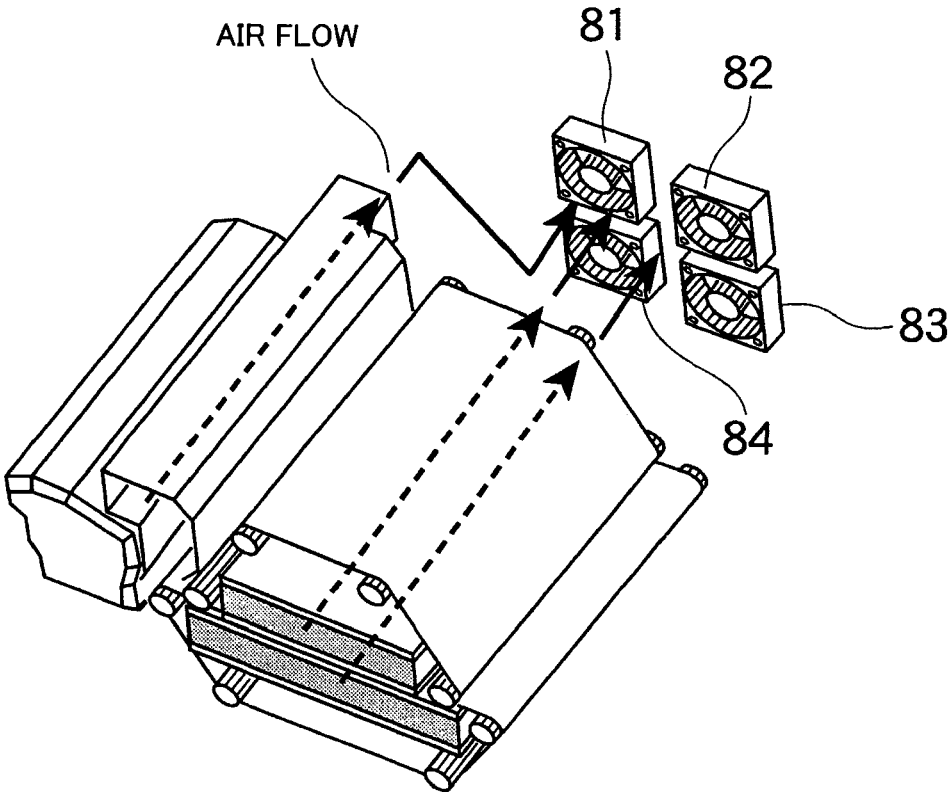
FIG. 12 is a perspective diagram showing a modification of the recording material cooling apparatus of Embodiment 5 of the invention.

FIG. 12 shows a modification of Embodiment 5. The modification is configured so that air also from the duct 52 is sucked by the suction fans 81 to 84.

The other configuration and function are identical with those of Embodiment 1, and hence their description is omitted.

Embodiment 6

Figure 13:
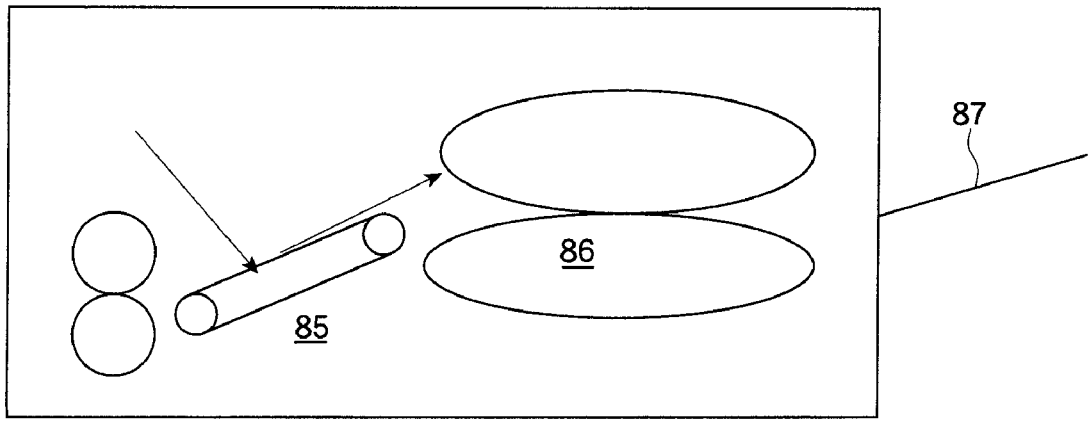
FIG. 13 is a diagram showing a recording material cooling apparatus of Embodiment 6 of the invention.

FIG. 13 shows Embodiment 6 of the invention. The following description will be made while the portions which are identical with those of Embodiment 1 are denoted by the same reference numerals. Embodiment 6 is configured by a conveyor belt 85 which conveys a recording sheet by the non-nipping portion 41, and a conveyor belt 86 which cooperates with the cooling belt to convey the recording sheet while nipping the sheet.

In the embodiment, the conveying path for the recording sheet which is conveyed from the fixing device 17 toward the cooling belt by the conveyor belt 85 is gently configured. In the embodiment, the position where the recording sheet is discharged from the fixing device is different from that of a discharge tray 87 for the recording sheet. The recording material cooling apparatus 20 is an apparatus having a large size. When the recording material cooling apparatus is obliquely disposed, the whole of the image forming apparatus has a large height. Therefore, the conveying path is changed by the conveyor belt 85.

In the embodiment, the conveyor belts 85, 86 are made of different materials. A recording sheet containing a large amount of vapor is in contact with the conveyor belt 85, and hence the belt is made of a material in which dew condensation occurs more hardly than in the conveyor belt 86. The pressure due to the cooling belt is applied to the conveyor belt 86 through the recording sheet. Therefore, the conveyor belt 86 is made of a material having an abrasion resistance which is higher than that of the conveyor belt 85.

The other configuration and function are identical with those of Embodiment 1, and hence their description is omitted.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A recording material cooling apparatus comprising:

a cooling belt that is in contact with a toner-image surface of a recording material on which a toner image is heated by a fixing device to be in a fusing state, to cool the recording material while conveying the recording material; and an air blowing unit or an air sucking unit, that is configured to cause air to flow across the toner-image surface of the recording material at a position between the fixing device and the cooling belt, the toner-image surface being in the fusing state.

2. The recording material cooling apparatus according to claim 1, wherein the apparatus further comprises a conveyor belt that is in contact with a surface of the recording material that is opposite to the toner image in the fusing state caused by heating of the fixing device, and that cooperates with the cooling belt to nip and convey the recording material.

3. The recording material cooling apparatus according to claim 1, wherein the air blowing unit blows air from an upstream side in a direction of conveying the recording material to a downstream side.

4. The recording material cooling apparatus according to claim 1, wherein the apparatus comprises both the air blowing unit and the air sucking unit.

5. The recording material cooling apparatus according to claim 4, wherein an air flow is made at a region from the air blowing unit to the air sucking unit excluding the fixing device.

6. The recording material cooling apparatus according to claim 1, wherein the apparatus further comprises an intermediate conveyor belt that conveys the recording material between the fixing device and the cooling belt.

7. An image forming apparatus comprising:

a toner-image forming portion that forms an image on a recording material;

a fixing device that heats the recording material to fix the toner image onto the recording material; and the recording material cooling apparatus according to claim 1, in which the fixing device heats a toner image formed by the toner-image forming portion, to fix the toner image onto the recording material.

8. The image forming apparatus according to claim 7, wherein the air blowing unit functions also as an air discharging unit that exhausts air in a vicinity of the toner-image forming portion.

9. The image forming apparatus according to claim 7, wherein the recording material cooling apparatus further comprises a conveyor belt that is in contact with a surface of the recording material that is opposite to the toner image in the fusing state caused by heating of the fixing device, and that cooperates with the cooling belt to nip and convey the recording material.

10. The image forming apparatus according to claim 7, wherein the air blowing unit blows air from an upstream side in a direction of conveying the recording material to a downstream side.

11. The image forming apparatus according to claim 7, wherein the recording material cooling apparatus comprises both the air blowing unit and the air sucking unit.

12. The image forming apparatus according to claim 11, wherein the air flow is made at a region from the air blowing unit to the air sucking unit excluding the fixing device.

13. The image forming apparatus according to claim 7, wherein the recording material cooling apparatus further comprises an intermediate conveyor belt that conveys the recording material between the fixing device and the cooling belt.

14. The image forming apparatus according to claim 1, wherein the air blowing unit includes a fan upstream of the position between the fixing device and the cooling belt.

15. The image forming apparatus according to claim 1, wherein the air sucking unit includes a fan downstream of the position between the fixing device and the cooling belt.

16. A recording material cooling apparatus comprising:

a cooling belt that is in contact with a toner-image surface of a recording material on which a toner image is heated by a fixing device to be in a fusing state, to cool the recording material while conveying the recording material; and an air blowing unit that blows air on the toner-image surface of the recording material at a position between the fixing device and the cooling belt, the toner-image surface being in the fusing state.

17. A recording material cooling apparatus comprising:

a cooling belt that is in contact with a toner-image surface of a recording material on which a toner image is heated by a fixing device to be in a fusing state, to cool the recording material while conveying the recording material; and an air sucking unit that sucks air from the toner-image surface of the recording material at a position between the fixing device and the cooling belt, the toner-image surface being in the fusing state.

* * * * *